US008258640B2

(12) United States Patent
Conway et al.

(10) Patent No.: US 8,258,640 B2
(45) Date of Patent: Sep. 4, 2012

(54) POWER SYSTEM HAVING TRANSIENT CONTROL

(75) Inventors: Scott Robert Conway, Griffin, GA (US); Bryan Matthew Fore, Griffin, GA (US)

(73) Assignee: Caterpillar Inc., Peoria, IL (US)

( * ) Notice: Subject to any disclaimer, the term of this patent is extended or adjusted under 35 U.S.C. 154(b) by 754 days.

(21) Appl. No.: 12/289,600

(22) Filed: Oct. 30, 2008

(65) Prior Publication Data

US 2010/0109344 A1 May 6, 2010

(51) Int. Cl.
*F02D 35/00* (2006.01)

(52) U.S. Cl. ..... 290/40 A; 322/4

(58) Field of Classification Search ..... 290/40 A, 290/40 B, 40 C, 1 A; 322/4; 74/572; 310/74; 701/101; 123/339
See application file for complete search history.

(56) References Cited

U.S. PATENT DOCUMENTS 6,611,068 B2 8/2003 Cratty
6,657,321 B2 12/2003 Sinha
6,718,768 B2 * 4/2004 Shaffer ..... 60/605.1
6,787,933 B2 9/2004 Claude et al.
6,891,279 B2 * 5/2005 Kazama ..... 290/40 C
6,958,550 B2 * 10/2005 Gilbreth et al. ..... 290/52
7,061,139 B2 6/2006 Young et al.
7,227,278 B2 6/2007 Realmuto et al.
7,425,807 B1 * 9/2008 Perkins et al. ..... 318/161
2004/0135436 A1 7/2004 Gilbreth et al.
2005/0012395 A1 1/2005 Eckroad et al.
2007/0005192 A1 1/2007 Schoettle et al.
2007/0246942 A1 10/2007 Stahlhut et al.
2008/0093864 A1 4/2008 Kagoshima et al.
2010/0106389 A1 * 4/2010 Fore et al. ..... 701/102

FOREIGN PATENT DOCUMENTS

JP 2007-325385 A 12/2007

* cited by examiner

*Primary Examiner* — Michael Zarroli
(74) *Attorney, Agent, or Firm* — Finnegan, Henderson, Farabow, Garrett & Dunner LLP.

(57) ABSTRACT

A power system is disclosed. The power system may have an engine with a desired operating speed range, and a generator mechanically driven by the engine to produce electrical power directed to an external load. The power system may also have a power storage device associated with at least one of the engine and the generator, and a controller in communication with the engine and the power storage device. The controller may be configured to determine a speed of the engine deviating from the desired operating range, and to activate the power storage device to absorb or supplement at least a portion of the electrical power directed to the external load based on the determination.

16 Claims, 2 Drawing Sheets

POWER SYSTEM HAVING TRANSIENT CONTROL

TECHNICAL FIELD

The present disclosure relates generally to a power system, and more particularly, to a power system having transient control.

BACKGROUND

A generator set (genset) includes a combination of a generator and a prime mover, for example a combustion engine. As a mixture of fuel and air is burned within the engine, a mechanical rotation is created that drives the generator to produce electrical power. Ideally, the engine drives the generator with a relatively constant torque and speed, and the generator accordingly produces an electrical power output having relatively constant characteristics (frequency, voltage, etc.).

Gensets are often used as a backup source of power. That is, a primary source of power such as a utility grid is typically connected to supply power for critical use, for example, to supply a hospital or a manufacturing facility with power. And, when the primary source of power fails, the genset is brought online to provide backup power for the critical use. When the primary source of power is reconnected to supply power for the critical use, the genset is returned to standby operation. Although effective, the genset cannot respond immediately to the sudden power outage or restoration. As such, without intervention, an interruption in power provided for the critical use may occur.

Gensets may be used in conjunction with an uninterruptible power supply (UPS). In most cases, the UPS stores energy by drawing power from the primary power source while the primary power source is enabled and online. In this manner, the UPS functions as an energy storage device. And, should the primary power source become disabled or disconnected, the UPS provides immediate backup power for the critical use until the genset is activated and brought up to speed, at which time the UPS may transfer load feeding responsibilities back to the genset.

Although a combined genset and UPS system may provide reliable solutions to complete power failures, the system may still experience performance fluctuations as a result of sudden load changes. That is, a load on the generator, and subsequently the engine, can be affected by external factors that can't always be precisely controlled. And, sudden changes in load can affect operation of the engine and subsequently cause undesirable fluctuations in characteristics of the generator's electrical power output.

One attempt to minimize fluctuations in characteristics of the electrical power output provided by a genset is described in U.S. Pat. No. 6,657,321 (the '321 patent) issued to Sinha on Dec. 2, 2003. The '321 patent discloses an uninterruptable power supply system having a turbine-driven generator and an energy storage system. The energy storage system is configured to supply a substantially constant DC load voltage by adjusting an amount of fuel supplied to the turbine and by adjusting an amount of supplemental DC power supplied by the energy storage system for use by the load. The energy storage system can be used to absorb and source transient power while the turbine control reacts to changes in the load. The energy storage system may comprise systems such as batteries, flywheels, superconducting magnetic energy storage systems, or combinations thereof. In one embodiment, in response to an excess in DC load voltage, the energy storage system is used to absorb excess DC power. In a more specific embodiment, the absorbing of excess DC power by the energy storage system is combined with supplying a decreased level of fuel in response to an excess in DC load voltage.

Although the system of the '321 patent may be helpful in minimizing power fluctuations in a DC power generating application, the system may be limited. That is, control based only on response to DC voltage output (excess or shortage) may be inadequate in some situations. In addition, the system of the '321 patent may be inapplicable to AC power system applications.

SUMMARY

One aspect of the present disclosure is directed to a power system. The power system may include an engine with a desired speed range, and a generator mechanically driven by the engine to produce electrical power directed to an external load. The power system may also include a power storage device associated with at least one of the engine and the generator, and a controller in communication with the engine and the power storage device. The controller may be configured to determine a speed of the engine deviating from the desired operating range, and to activate the power storage device to absorb or supplement at least a portion of the electrical power directed to the external load based on the determination.

Another aspect of the present disclosure is directed to another power system. This power system may include a generator set having a desired operating range and being configured to supply electrical power to an external load, and a power storage device associated with the generator set. The power system may also include a controller in communication with the generator set and the power storage device. The controller may be configured to determine a change in the external load, and to activate the power storage device to absorb or supplement at least a portion of the electrical power supplied to the external load when the change in the external load will cause operation of the generator set to deviate from the desired operating range.

In yet another aspect, the present disclosure is directed to a method of operating a generator set. The method may include combusting a mixture of fuel and air to generate electrical power, and directing the electrical power to an external load. The method may also include determining an engine speed of the generator set, and comparing the engine speed to a desired engine speed. The method may further include absorbing or supplementing at least a portion of the electrical power directed to the external load based on the comparison.

DETAILED DESCRIPTION

Figure 1:
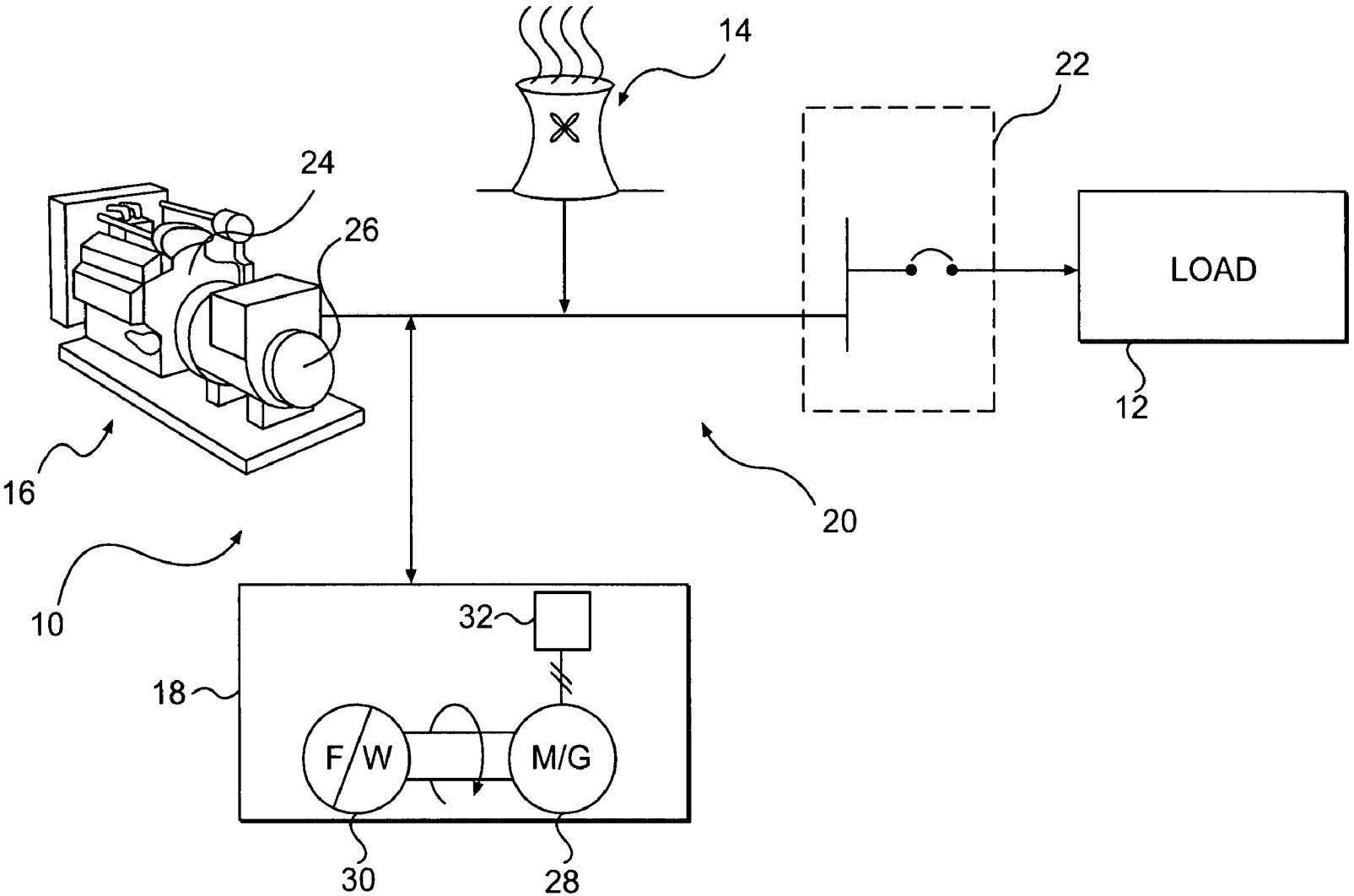
FIG. 1 is a diagrammatic illustration of an exemplary stationary power system.

FIG. 1 illustrates an exemplary power system 10 consistent with certain disclosed embodiments. Power system 10 may be configured to provide backup power to an external load 12. In one exemplary embodiment, backup power may include an immediate supply of reserve power provided to external load 12 when power supplied from a utility power grid 14 is interrupted. It is contemplated, however, that in some embodiments, power system 10 may be configured as a primary source of power, if desired. As shown in FIG. 1, power system 10 may include a generator set (genset) 16 and a transient load management system (TLMS) 18. Genset 16 and TLMS 18 may be connected to each other and both connected to external load 12 by way of a power transmission network 20 and a connection 22.

Utility power grid 14 may be an electricity generation and/or distribution system that generates and delivers electrical power through a centralized power grid. In one embodiment, utility power grid 14 may be configured as the primary source of power for external load 12. For example, utility power grid 14 may include a nuclear-generated electrical power plant, a wind-powered generator, a solar-powered generator, a hydroelectric power plant, etc. In one exemplary embodiment, utility power grid 14 may be a fee-based electricity generation and/or distribution system that provides electrical power to one or more customers. In another exemplary embodiment, utility power grid 14 may be a mobile, self-supporting, electricity generation and/or distribution system such as, for example, a machine (e.g., construction equipment and/or agricultural equipment) or motorized vehicle (e.g., a bus or a truck). One skilled in the art will appreciate that utility power grid 14 may produce electrical power in multiple phases and/or different frequencies based upon requirements of external load 12. In one example, utility power grid 14 may produce and/or supply electrical power in the form of an alternating electric current such as, for example, three-phase alternating current with a preset frequency (e.g., 50 Hz, 60 Hz, or any other suitable frequency).

External load 12 may include any type of power consuming system or device configured to receive electrical power supplied by utility power grid 14 and to utilize the electrical power to perform some type of task. External load 12 may include, for example, lights, motors, heating elements, electronic circuitry, refrigeration devices, air conditioning units, computer servers, etc. In one exemplary embodiment, external load 12 may include one or more systems and/or devices that utilize uninterrupted electrical power to perform one or more critical and/or sensitive tasks. For example, electrical loads 12 that utilize uninterrupted power may include those found in hospitals, airports, computer servers, telecommunication installations, and/or industrial applications.

Transmission network 20 may embody any electrical transmission system for distributing electrical power generated by utility power grid 14 to external load 12. For example, transmission network 20 may include a system comprised of power stations, transmission lines, connection equipment (e.g., transformers, electrical switches, power relays, circuit breakers, and the like), and other suitable devices for distributing electrical power across a power grid. In one embodiment, portions of transmission network 20 may be buried underground and/or run overhead via transmission towers.

Connection 22 may include any type of electrical connector or system that is capable of coupling together one or more of genset 16, TLMS 18, utility power grid 14, and/or external load 12. For example, connection 22 may include various junction boxes, circuit interrupting devices, fuses, or any other components that may be suitable for electrically interconnecting one or more systems. Connection 22 may also or alternatively include a voltage transformer configured to reduce or otherwise condition the voltage of power provided by genset 16, TLMS 18, and/or utility power grid 14 to a suitable level for use by conventional consumer devices.

Genset 16 may include any component or components that operate to generate electricity. In one embodiment, genset 16 may comprise a prime mover 24 coupled to mechanically rotate a generator 26 that provides electrical power to external load 12. For the purposes of this disclosure, prime mover 24 is depicted and described as a heat engine, for example an internal or external combustion engine that combusts a mixture of fuel and air to produce the mechanical rotation. One skilled in the art will recognize that prime mover 24 may be any type of combustion engine such as, for example, a diesel engine, a gasoline engine, or a gaseous fuel-powered engine. As such, prime mover 24 may have a desired operating range and, when operating within this range, performance of prime mover 24 may be substantially consistent and efficient, and the electrical output of generator 26 may have characteristics (e.g., voltage, frequency, etc.) that are substantially consistent. In one example, the desired operating range may be associated with a rotational speed of prime mover 24. When the speed of prime mover 24 decreases below the desired operating range, prime mover 24 may be considered to be lugging and the electrical output of generator 26 may degrade. Similarly, when the speed of prime mover 24 increases above the desired operating range, prime mover 24 may be considered to be overspeeding and the electrical output of generator 26 may again degrade. It is contemplated that prime mover 24 may alternatively embody a non-combustion source of power, for example, a fuel cell, if desired.

Generator 26 may be, for example, an AC induction generator, a permanent-magnet generator, an AC synchronous generator, or a switched-reluctance generator that is mechanically driven by prime mover 24 to produce electrical power. In one embodiment, generator 26 may include multiple pairings of poles (not shown), each pairing having three phases arranged on a circumference of a stator (not shown) to produce an alternating current. Electrical power produced by generator 26 may be directed for offboard purposes to external load 12.

TLMS 18 may include a plurality of components and subsystems for generating and maintaining a source of power for system 10. Specifically, TLMS 18 may comprise a power electronic (PE) 28 and an energy storage device 30. Energy storage device 30 may include any device that can store energy in kinetic or potential forms such as, for example, a flywheel (shown in FIG. 1 as F/W), an inductor, a battery, a capacitor, and/or a fluid accumulator. The power supplied to TLMS 18 may be used by PE 28 to charge and/or maintain a charge within energy storage device 30. During normal operation (i.e., when utility power grid 14 is providing power to external load 12), TLMS 18 may receive power from utility power grid 14. During interruptions of utility power (i.e., when genset 16 is providing power to external load 12), TLMS 18 may receive power from genset 16. At any point in time, TLMS 18 may selectively absorb excess power supplied to external load 12 by charging energy storage device 30, or supplement the power directed to external load 12 by discharging energy storage device 30 via PE 28.

In one example, TLMS 18 may function as an uninterruptible power supply (UPS). That is, when utility power grid 14 fails to supply power to external load 12 and before genset 16 can ramp up operation to the required power output, TLMS 18 may supply the necessary power demanded by external load 12 such that the supply of power to external load 12 is substantially uninterrupted. As a UPS, TLMS 18 may be required to produce the full demand of external load 12 for the period of time it takes for genset 16 to change status from standby to fully operational.

In another example, TLMS 18 may function to only help maintain consistent electrical output of genset 18 under varying loads, after genset 18 is already fully operational. In this application, TLMS 18 may have a smaller capacity than if TLMS 18 had UPS functionality. For example, in an application where genset 16 is capable of producing about 1,000 kw, TLMS 18 might be capable of only absorbing and producing about 100-200 kw for short bursts of about 5 sec. In this application, TLMS 18 may not function to transition power supply from utility to genset and vice versa, but only smooth operation of genset 16 under transient loading. It is contemplated however, that TLMS 18 may have both UPS and fully-operational transient capabilities, if desired.

PE 28 may embody an electronic device that is configured to convert, condition, and/or regulate the production, absorption, and discharge of electrical power within TLMS 18 (i.e., the flow of power to and from energy storage device 30). In one embodiment, PE 28 may be configured to regulate the flow of electrical power by receiving an input of fixed or variable-frequency, alternating current (AC) from utility power grid 14 and/or genset 16, and by providing a mechanical or electrical output to energy storage device 30. For example, PE 28 may embody a motor/generator (shown as M/G in FIG. 1) that can be electrically driven by utility power grid 14 or genset 16 to mechanically rotate the flywheel of energy storage device 30, thereby converting the supplied electrical energy to stored kinetic energy in the form of flywheel rotation. PE 28 may further be configured to output a variable- or fixed-frequency, alternating current when mechanically or electrically powered by energy storage device 30. For example, PE 28, as a motor/generator, may be mechanically driven by the flywheel of energy storage device 30 to produce current directed to external load 12, thereby converting the stored kinetic energy back into electrical energy.

As described above, TLMS 18 may be configured to operate in multiple modes of operation, including a standby mode associated with consistent power supply from utility power grid 14 or genset 16, a transition mode associated with power supply shifts from utility power grid 14 to genset 16 and vice versa, and a transient mode associated with power supply from genset 16 when sudden demand fluctuations from external load 12 occur. Alternatively, TLMS 18 may only be operable in one of the transition and transient modes (i.e., TLMS 18 may not be sized for transitional operations in some applications). During the standby mode of operation, when utility power grid 14 is capable of sustaining external load 12, PE 28 may forward residual power from utility power grid 14 to energy storage device 30 in order to maintain a desired level of stored energy within energy storage device 30. When an interruption of power supply from utility power grid 14 occurs (i.e., when utility power grid 14 fails or otherwise is insufficient to satisfy the demands of external load 12) and TLMS 18 is operating in the transitional mode, PE 28 may draw stored power from energy storage device 30 to properly sustain external load 12 until genset 16 can be brought online as the backup power source. Alternatively or additionally, when genset 16 is providing power to external load 12, PE 28 may cause energy storage device 30 to selectively absorb or supplement the power provided by genset 16 to external load 12 such that fluctuating load demands of external load 12 can be satisfied in an efficient and desired manner (i.e., without causing the engine speed of genset 16 to deviate from the desired operating range). Accordingly, TLMS 18 may be provided with a controller 32 to help regulate operation in these different modes.

Controller 32 may embody a single or multiple microprocessors, field programmable gate arrays (FPGAs), digital signal processors (DSPs), etc. that include a means for controlling an operation of TLMS 18 in response to various input. Numerous commercially available microprocessors can be configured to perform the functions of controller 32. It should be appreciated that controller 32 could readily embody a microprocessor separate from that controlling other power system functions, or that controller 32 could be integral with a general power system microprocessor and be capable of controlling numerous power system functions and modes of operation. If separate from the general power system microprocessor, controller 32 may communicate with the general power system microprocessor via datalinks or other methods. Various other known circuits may be associated with controller 32, including power supply circuitry, signal-conditioning circuitry, actuator driver circuitry (i.e., circuitry powering solenoids, motors, or piezo actuators), communication circuitry, and other appropriate circuitry.

According to one embodiment, controller 32 may be configured to monitor performance of power system 10 and responsively regulate operation of TLMS 18. For example, controller 32 may monitor a voltage, a current, and/or a frequency characteristic of the electrical power provided to external load 12. And, in response to an interruption of the supplied power (during transitional operation) or a deviation of the supplied power from a desired power level (during transient operation), controller 32 may selectively activate, deactivate, or adjust activation of TLMS 18 to supplement or absorb the power being directed to external load 12. Additionally or alternatively, controller 32 may monitor operation of genset 16, more specifically of prime mover 24, and in response to an operational interruption or deviation from the desired operating range (e.g., in response to lugging or overspeeding of prime mover 24), controller 32 may activate, deactivate, or adjust activation of TLMS 18. In this manner, the actual demands of external load 12 may be satisfied without causing operation of genset 16 to deviate from the desired operating range (i.e., without causing prime mover 24 to lug or overspeed significantly in response to a sudden increase or decrease in load demand).

According to another embodiment, controller 32 may predictively regulate operation of TLMS 18. Specifically, in response to a measured, calculated, or assumed power demand change of external load 12, controller 32 may selectively activate, deactivate, or adjust activation of TLMS 18. Similarly, in response to an indication of a desired load change, controller 32 may regulate operation of TLMS 18 to accommodate the change before the change can be measured, calculated, or assumed. In this manner, predicted demand changes of external load 12 may be satisfied before they are actually experienced by genset 16 (i.e., before the demand changes cause undesired performance of prime mover 24 and/or generator 26).

Controller 32 may regulate operation of TLMS 18 to absorb or supplement power provided to external load 12 during the transitional and transient modes of operation by selectively causing energy storage device 30 to be charged or discharged. For example, during the transitional mode of operation, in response to a sudden interruption of the power provided from utility power grid 14 to external load 12, controller 32 may cause energy storage device 30 to discharge stored power through PE 28 to external load 12. And, this discharge of power may continue until genset 16 is fully operational and brought online to provide backup power, until the power demand from external load 12 diminishes, or until energy storage device 30 has depleted its store of power. Similarly, during the transitional mode of operation, after service from utility power grid 14 has been restored and while genset 16 is powering down, controller 32 may cause PE 28 to direct residual power from genset 16 to charge energy storage device 30. This charging of power may continue until genset 16 is non-operational or until energy storage device 30 is fully charged.

During the transient mode of operation, controller 32 may similarly cause energy storage device 30 to absorb or supplement the power provided to external load 12. For example, during genset operation and in response to an actual or predicted sudden increase in load demand, controller 32 may cause PE 28 to discharge power from energy storage device 30 to external load 12 to account for the increase in demand such that operation of genset 16 remains within the desired operating range (i.e., such that the engine speed of prime mover 24 is inhibited from lugging and characteristics of the electrical power provided by genset 26 remain as desired) and the load demand increase is satisfied. Similarly, in response to an actual or predicted sudden decrease in load demand during genset operation, controller 32 may cause PE 28 to direct excess power from genset 16 to charge energy storage device 30 and account for the decrease such that operation of genset 16 remains within the desired operating range (i.e., such that the engine speed of prime mover 24 is inhibited from overspeeding and characteristics of the electrical power provided by genset 26 remain as desired).

In one embodiment, a speed of energy storage device 30 may change when charging or discharging power. Specifically, as a flywheel, energy storage device 30 may rotate at a speed corresponding to an amount of stored power. Thus, when that amount of stored power increases, the speed of the flywheel may increase by a corresponding amount. Similarly, when the amount of power stored within energy storage device 30 decreases, the speed of the flywheel may decrease by a corresponding amount.

Controller 32 may be configured to maintain a desired speed of energy storage device 30 during operation of power system 10 in preparation for future discharging events. In one embodiment, the desired speed may be about 5,000 rpm, and controller 32 may cause PE 28 to continuously mechanically drive energy storage device 30 at this speed during normal operations of genset 16 and/or utility power grid 14 (during steady state operations). During a charging event, when excess power produced by genset 16 is being absorbed by TLMS 18 in response to a sudden decrease in load demand or power down of genset 16, the speed of energy storage device 30 may be allowed to increase to a maximum limit. In one example, the maximum limit may be about 8,000 rpm, or about 60% greater than the desired speed. During a discharging event when TLMS 18 is supplementing the power directed to external load 12 to satisfy a sudden increase in load demand to help transition power supply from utility power grid 14 to genset 16, the speed of energy storage device 30 may be allowed to decrease as low as about 3,000 rpm or about 60% of the desired speed.

Figure 2:
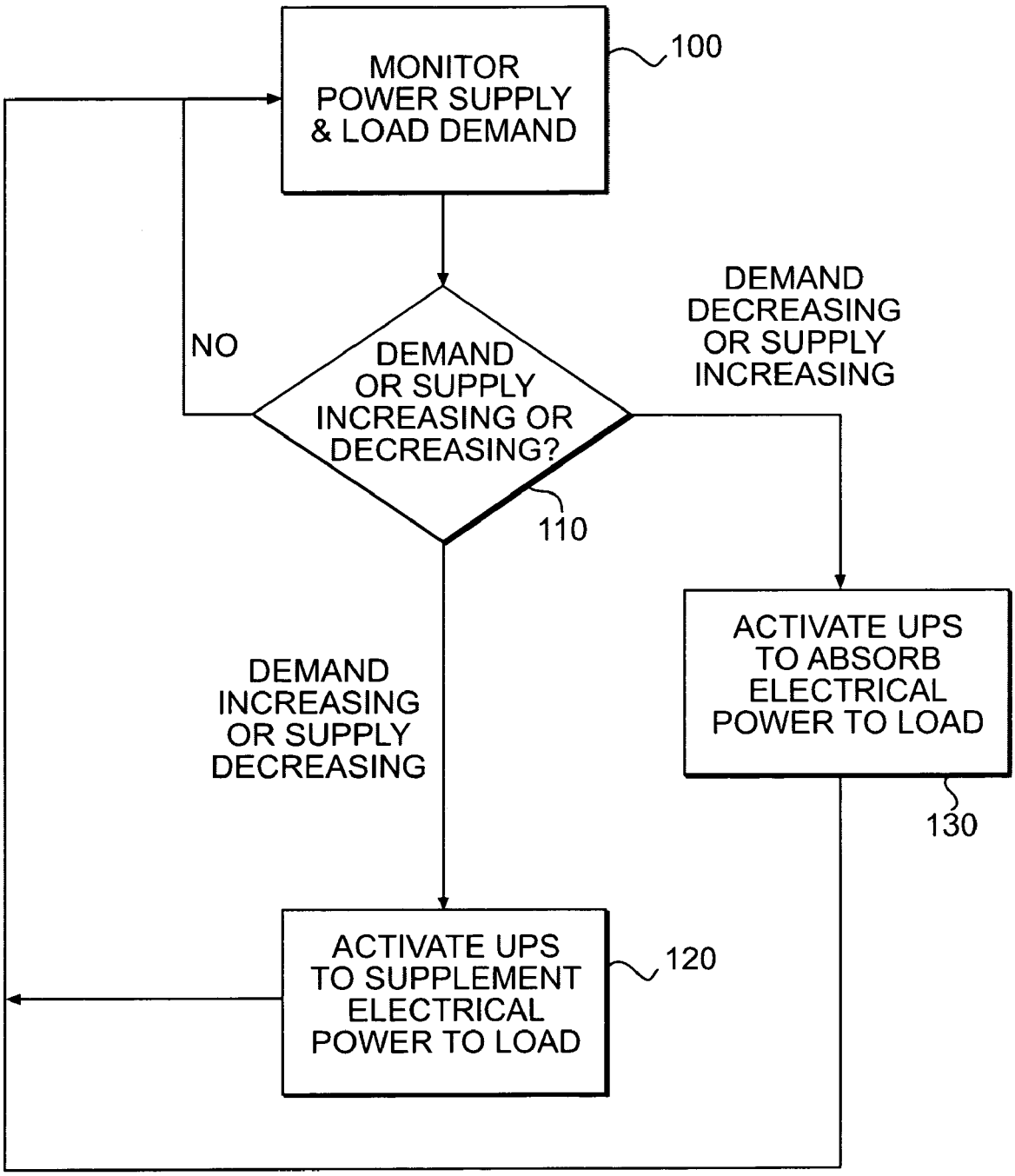
FIG. 2 is a flowchart illustrating an exemplary disclosed method for operating the power system of FIG. 1.

FIG. 2 may illustrate an exemplary operation of power system 10. FIG. 2 will be discussed in more detail in the following section to further illustrate the disclosed concepts.

Industrial Applicability

The disclosed power system may provide consistent power to an external load in an efficient manner. In particular, the disclosed power system may be used during a transitional period when a primary power source has failed or has been restored to help transition power supply to or from a backup power source. The disclosed system may also or alternatively be used during a transient period of backup power source operation to accommodate sudden load changes that might otherwise cause inefficient or undesired operation of the backup power source. FIG. 2 illustrates a flowchart depicting an exemplary method for operating power system 10 to provide uninterruptible power to external load 12. FIG. 2 will be now be discussed in detail.

During operation of power system 10, controller 32 may monitor characteristics associated with the power supplied to external load 12 and/or associated with demand changes of external load 12 (step 100). For example, controller 32 may use current sensors, voltage sensors, frequency sensors, engine speed sensors, internal calculations or assumptions, operator input, etc. to passively and/or actively monitor supply voltage, supply current, supply frequency, genset performance (e.g., prime mover performance), utility operation, and/or external load demand changes. Controller 32 may then use these monitored characteristics to determine whether there has been or will be a change (i.e., an increase or a decrease) in power demand or power supply (Step 110). That is, controller 32 may use the characteristics to determine if there has been an interruption in the power supplied to external load from utility power grid 14 (i.e., if utility power grid 14 has failed and power system 10 is operating in the transitional mode), or if during operation of genset 16, a demand for power from external load 12 has suddenly changed or will change (i.e., if power system 10 is operating in the transient mode). In any of these situations, there may be a risk of power being supplied to external load 12 with undesired characteristics (voltage, frequency, etc.) or of suboptimal prime mover operation (e.g., lugging or overspeeding).

If utility power grid 14 is able to feed external load 12 with sufficient electrical power, controller 32 may continue the monitoring of supply and demand (step 110: No) (TLMS 18 is in the standby mode and control will return to step 100). Furthermore, while utility power grid 14 is adequately supplying electrical power to external load 12, utility power grid 14 may also charge or maintain the charge of energy storage device 30 by way of PE 28, if desired. For example, in one embodiment, utility power grid 14 may supply PE 28 with fixed-frequency AC electrical power. And, PE 28 may use the electrical power to charge energy storage device 30 (e.g., to mechanically rotate the flywheel of energy storage device 30 to the desired speed).

If utility power grid 14 is unable to supply external load 12 with the appropriate electrical power (step 110: Demand Increasing or Supply Decreasing) (i.e., if utility power grid 14 has failed and power system is operating in the transitional mode), TLMS 18 may be activated to supplement the electrical power directed to external load 12 (step 120) until genset 16 can be started and brought online to provide backup power. In this situation, during the transition from utility power supply to genset power supply, energy storage device 30 may supplement the electrical power directed to external load 12 via connection 22 to satisfy power demands. Once genset 16 is brought online and available, genset 16 may assume load feeding responsibilities from TLMS 18, and control may return to step 100.

If, during operation of TLMS 18 in the transitional mode, controller 32 determines at step 100 that the functionality of utility power grid 14 has been restored (step 110: Demand Decreasing or Supply Increasing), TLMS 18 may be activated to absorb at least a portion of the electrical power directed to external load 12 by genset 16 (Step 130) until genset 16 can be deactivated. Once genset 16 is deactivated, TLMS 18 may be returned to standby mode operation and charged by utility power grid 14, if desired. After completion of step 130, control may return to step 100.

Returning again to step 110, if power system 10 is operating in the transient mode and the demand for power from external load 12 suddenly increases (step 110: Demand Increasing or Supply Decreasing), TLMS 18 may be activated as described above to supplement the electrical power directed to external load 12 (step 120) until genset 16 can recover from the sudden increase and provide backup power while maintaining performance within the desired operating range. Similarly, if at step 110, power system 10 is operating in the transient mode and the demand for power from external load 12 suddenly decreases (step 110: Demand Decreasing or Supply Increasing), TLMS 18 may be activated as described above to absorb at least a portion of the electrical power directed to external load 12 (Step 130) until genset 16 can recover from the sudden decrease.

For example, during the transient mode of operation, when genset 16 is providing power to external load 12, controller 32 may use an engine speed sensor (not shown) to monitor performance of genset 16. Controller 32 may then compare an actual engine speed to the desired operating range to determine if prime mover 24 is lugging or overspeeding. If lugging is determined, it can be concluded that the demand of external load 12 has suddenly increased and prime mover 24 has not yet been able to recover from the increased load. In contrast, if overspeeding is determined, it can be concluded that the demand of external load 12 has suddenly decreased and prime mover 24 has not yet been able to recover. Based on the speed comparisons, controller 32 may activate TLMS 18 to either supplement power or absorb excess power provided to external load 12 until genset 16 has recovered from the sudden increase or decrease in load demand.

The disclosed power system may have wide application. Specifically, because controller 32 may trigger activation or deactivation of TLMS 18 based on power supply changes, load demand changes, and/or genset performance (i.e., actual or predicted prime mover speed deviations), power system 10 may be able to provide substantially consistent power supply. And, although primarily intended for use with AC power loads, the disclosed power system may also or alternatively be utilized with DC power loads.

It will be apparent to those skilled in the art that various modifications and variations can be made to the disclosed power system. Other embodiments will be apparent to those skilled in the art from consideration of the specification and practice of the power system disclosed herein. For example, it is contemplated that TLMS 18 may be utilized both as a UPS and a transient control system, as a stand-along transient control system, or as an add-on transient control system that functions in conjunction with an existing UPS. It is intended that the specification and examples be considered as exemplary only, with a true scope of the disclosure being indicated by the following claims and their equivalents.

What is claimed is:

1. A power system, comprising:

an engine having a desired speed range;

a generator mechanically driven by the engine to produce electrical power directed to an external load;

a power storage device associated with at least one of the engine and the generator, the power storage device being configured to:

be driven by a utility power source when the utility power source is online; and be driven by the engine and generator when the engine and the generator are online; and a controller in communication with the engine and the power storage device, the controller being configured to:

determine a speed of the engine deviating from the desired speed range; and activate the power storage device to absorb or supplement at least a portion of the electrical power directed to the external load based on the determination;

the power system being configured to function as a backup power supply to the utility power source.

2. The power system of claim 1, wherein the power storage device includes a flywheel and an associated motor/generator.

3. The power system of claim 2, wherein the flywheel is continuously mechanically driven by the motor/generator to rotate at a desired speed greater than zero during normal operations of the power system, and selectively mechanically driven by the motor/generator during power absorbing operations.

4. The power system of claim 3, wherein:

the motor/generator is electrically driven by the generator during normal and power absorbing operations; and the motor/generator is mechanically driven by the flywheel during power supplementing operations.

5. The power system of claim 3, wherein the desired speed is about 5000 rpm.

6. The power system of claim 5, wherein the flywheel speeds up when absorbing power and slows down when supplementing power.

7. The power system of claim 6, wherein a speed of the flywheel is limited within a desired range when absorbing and supplementing power.

8. The power system of claim 7, wherein the desired range of the flywheel is about 3000 rpm to about 8000 rpm.

9. A power system comprising:

an engine having a desired speed range;

a generator mechanically driven by the engine to produce electrical power directed to an external load;

a power storage device associated with at least one of the engine and the generator; and a controller in communication with the engine and the power storage device, the controller being configured to:

determine a speed of the engine deviating from the desired speed range; and activate the power storage device to absorb or supplement at least a portion of the electrical power directed to the external load based on the determination;

determine a change in the external load that will cause operation of the engine to deviate from the desired speed range; and activate the power storage device to absorb or supplement at least a portion of the electrical power directed to the external load based on the determination before operation of the engine deviates from the desired speed range as a result of the change in the external load.

10. A power system, comprising:

a generator set having a desired operating range and being configured to supply electrical power to an external load;

a power storage device associated with the generator set; and a controller in communication with the generator set and the power storage device, the controller being configured to:

determine a change in the external load; and activate the power storage device to absorb or supplement at least a portion of the electrical power supplied to the external load when the change in the external load will cause operation of the generator set to deviate from the desired operating range;

the power system functioning as a backup power supply to a utility power source, the power storage device being driven by the utility power source when the utility power source is online and the power storage device being driven by the generator set when the generator set is online.

11. The power system of claim 10, wherein the change is a speed change of the generator set.

12. The power system of claim 10, wherein the change is a change in a characteristic of electrical power produced by the generator set.

13. A method of operating a generator set, comprising:

combusting a mixture of fuel and air to generate electrical power;

directing the electrical power to an external load;

determining an engine speed of the generator set, the generator set functioning as a backup power supply to a utility power source;

comparing the engine speed to a desired engine speed;

absorbing or supplementing at least a portion of the electrical power directed to the external load based on the comparison;

determining an interruption in the power supplied from the utility power source to the external load when the generator set is offline; and supplementing the electrical power directed to the external load until the generator set is online.

14. The method of claim 13, wherein absorbing includes converting electrical power into stored mechanical rotational power, and supplementing includes converting stored mechanical rotational power into electrical power.

15. The method of claim 14, further including continuously converting electrical power into stored mechanical rotational power during normal operations of the generator set.

16. The method of claim 13, further including:

storing power from the utility power source when the utility power source is online; and storing power from the generator set when the generator set is online, wherein the supplemental electrical power directed to the external load is stored power.

* * * * *